US007661366B2

(12) United States Patent
Fuller et al.

(10) Patent No.: US 7,661,366 B2
(45) Date of Patent: Feb. 16, 2010

(54) SIGNAL CONDUCTING DETONATING CORD

(75) Inventors: John Fuller, Richmond, TX (US); Marcial Nakamura, Houston, TX (US); Michael Bertoja, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/960,863

(22) Filed: Dec. 20, 2007

(65) Prior Publication Data

US 2009/0159283 A1 Jun. 25, 2009

(51) Int. Cl.

| | |
|---|---|
| ***C06C 5/04*** | (2006.01) |
| ***F42B 1/02*** | (2006.01) |
| ***B64D 1/04*** | (2006.01) |
| ***F41F 5/00*** | (2006.01) |
| ***E21B 29/00*** | (2006.01) |

(52) U.S. Cl. ..... 102/275.8; 102/310; 89/1.15; 166/297

(58) Field of Classification Search ..... 166/297, 166/55.1, 4.6, 306, 310; 102/313, 322, 332, 102/275.1–275.8; 89/1.15
See application file for complete search history.

(56) References Cited

U.S. PATENT DOCUMENTS

| | | | | |
|---|---|---|---|---|
| 1,631,756 | A * | 6/1927 | Olin | 102/202.12 |
| 4,024,817 | A * | 5/1977 | Calder et al. | 102/275.8 |
| 4,403,143 | A * | 9/1983 | Walker et al. | 250/227.11 |
| 4,777,878 | A | 10/1988 | Johnson | |
| 4,886,126 | A * | 12/1989 | Yates, Jr. | 175/4.54 |
| 5,010,821 | A * | 4/1991 | Blain | 102/275.8 |
| 5,191,936 | A | 3/1993 | Edwards | |
| 5,436,791 | A | 7/1995 | Turano | |
| 5,505,134 | A | 4/1996 | Brooks | |
| 5,551,520 | A * | 9/1996 | Bethel et al. | 175/4.54 |
| 6,179,064 | B1 | 1/2001 | Vaynshteyn | |
| 6,523,449 | B2 * | 2/2003 | Fayard et al. | 89/1.15 |
| 6,598,682 | B2 | 7/2003 | Johnson | |
| 6,604,584 | B2 | 8/2003 | Lerche | |
| 6,719,061 | B2 | 4/2004 | Muller | |
| 6,752,083 | B1 | 6/2004 | Lerche | |
| 6,837,310 | B2 * | 1/2005 | Martin | 166/297 |
| 7,007,756 | B2 | 3/2006 | Lerche | |
| 7,146,912 | B2 | 12/2006 | Westberg et al. | |
| 7,172,023 | B2 | 2/2007 | Barker | |
| 7,303,017 | B2 * | 12/2007 | Barker et al. | 166/297 |
| 2004/0003743 | A1 | 1/2004 | Brooks | |
| 2006/0196665 | A1 * | 9/2006 | LaGrange et al. | 166/298 |

FOREIGN PATENT DOCUMENTS

| | | |
|---|---|---|
| GB | 2411222 | 8/2005 |
| GB | 2423138 | 8/2006 |

* cited by examiner

*Primary Examiner*—Jennifer H Gay
*Assistant Examiner*—James G Sayre
(74) *Attorney, Agent, or Firm*—Kevin Brayton McGoff; James L. Kurka; Trop, Pruner & Hu, P.C.

(57) ABSTRACT

A downhole perforating device includes: a perforating gun having incorporated therein at least two shape charges; an elongated detonating cord incorporated with the perforating gun and extending along a length of the perforating gun, the detonating cord including: a flexible jacket surrounding an explosive; and a communication medium extending within or attached onto the flexible jacket layer.

22 Claims, 2 Drawing Sheets

SIGNAL CONDUCTING DETONATING CORD

TECHNICAL FIELD

Embodiments in the present application relate to the field of explosive detonating cords, and more particularly to detonating cords in connection with downhole perforating of a hydrocarbon well.

BACKGROUND

A hydrocarbon well is typically lined by a well casing. The well casing is normally made of metal and is essentially impervious to well fluids. Thus, in order to harvest hydrocarbons, holes are created in the casing to allow well fluids to flow from a formation into the inside of the casing. Normally, the holes are created by detonating shape charges thereby propelling a mass though the well casing and into the surrounding formation. The holes in the well casing and the formation encourage flow of well fluid.

A perforating gun is used to perforate the casing and the formation. A perforating gun typically has a number of shape charges. The shape charges can be held in place by a sleeve that is located within an outer tube. Plural perforating guns can be connected in a string to create a perforating gun string.

The present application discusses some embodiments that address a number of issues associated therewith.

SUMMARY

A non-limiting embodiment is directed toward a downhole perforating device, comprising: a perforating gun having incorporated therein at least two shape charges; an elongated detonating cord incorporated with the perforating gun and extending along a length of the perforating gun, the detonating cord comprising: a flexible jacket surrounding an explosive; and a communication medium extending within or attached onto the flexible jacket layer.

DETAILED DESCRIPTION

In the following description, numerous details are set forth to provide an understanding of certain embodiments of the invention. However, it will be understood by those skilled in the art that the present invention may be practiced without many of these details and that numerous variations or modifications from the described embodiments are possible.

As used here, the terms "uphole" and "downhole", "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left, a right, a right to left, or a diagonal relationship as appropriate.

As noted above, perforating guns typically include shape charges. The shape charges can be detonated by way of a detonating cord. The detonating cord contains an explosive that extends longitudinally along the cord. Typically the explosive forms a core of the cord. The explosive could also have a hollow cross sectional shape, or be located within the cord in other ways.

The present application describes a detonating cord that includes an explosive part and a communicating medium, the explosive part and the communication medium being incorporated together in the cord, e.g. embedded in a flexible jacket. That configuration provides increased resilience to downhole environments and forces experienced during assembly of the perforating gun and placement of the perforating gun downhole, e.g., potential pulling, pressing and crimping of the cord. Various embodiments of that idea are described herein.

Figure 1:
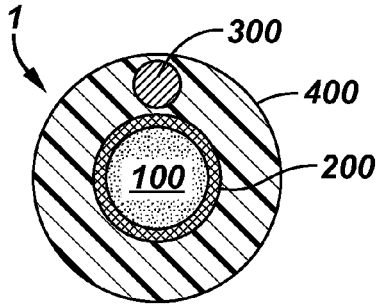
FIG. 1 is a cross-section of an embodiment.
Figure 4:
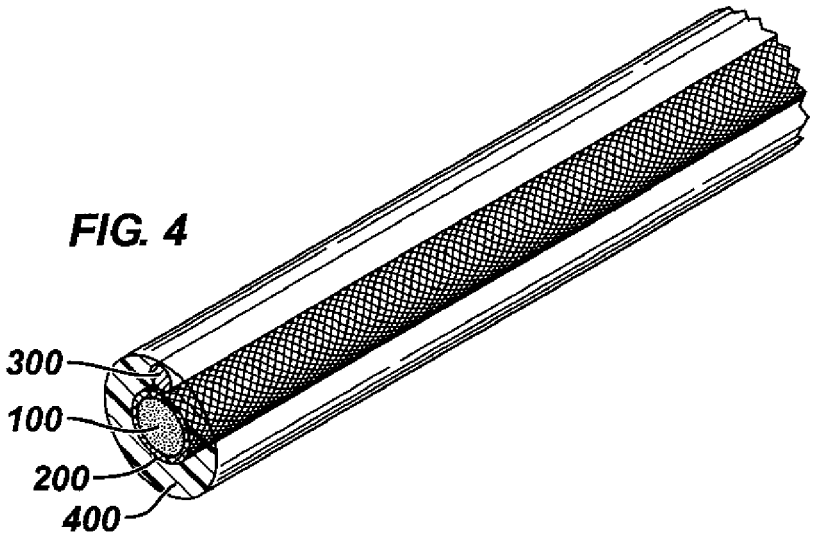
FIG. 4 is an isometric of the embodiment shown in FIG. 1.

FIG. 1 is a cross-sectional view of an embodiment of a detonating cord 1 according to the present application. FIG. 4 is an isometric view of the embodiment shown in FIG. 1. The detonating cord 1 has an explosive 100 that extends along a longitudinal path. The cord 1 also includes a communication medium 300 that can communicate signals and information. The communication medium 300 can be made of anything that adequately transmits signals/information, such as: metal wire, woven metal, fiber-optic cable, or a pressure conduit. A metal sheath could surround the explosive 100, and could be separated from the core 100 by an insulating layer, e.g., a woven fabric layer 200. Examples of materials that make up the communication medium 300 are: insulated or non-insulated wire, fiber optics, pressure tube, carbon conductor, etc. A jacket layer surrounds the explosive part 100 and the communication medium 300 so that the explosive part 100 and the communication medium 300 are essentially embedded within, or attached to, the flexible jacket 400. Examples of flexible jacket material that can be used are: elastomers, lead, soft metals, plastics, fibrous materials, fabric, etc. If the flexible jacket 400 is formed of a conductive material, e.g. lead or soft metal, the flexible jacket 400 can be used to as a communication medium.

Figure 5:
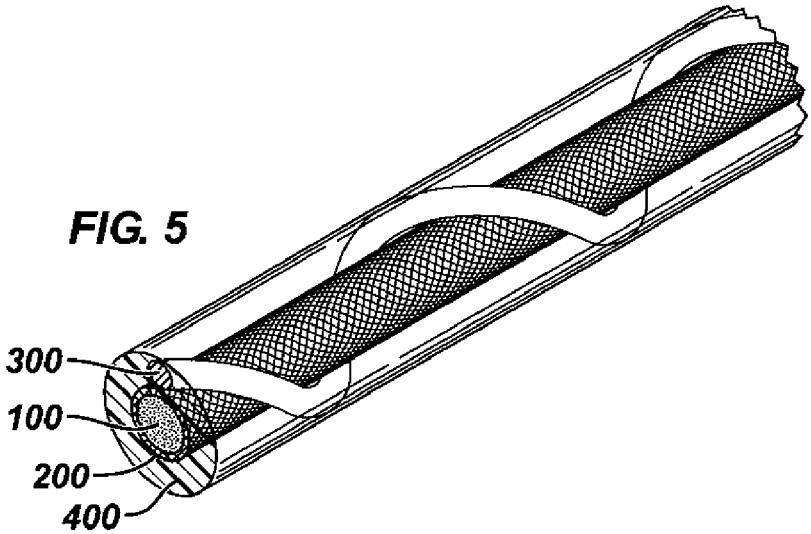
FIG. 5 is an isometric of an embodiment.
Figure 6:
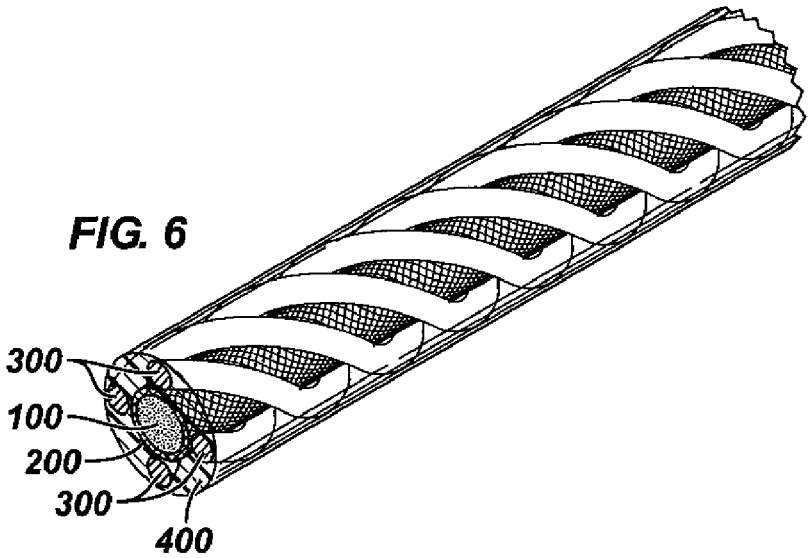
FIG. 6 is an isometric of an embodiment.

In the figures, the communication medium 300 and the explosive part 100 are shown as being adjacent to one another. The cloth layer 200 can wrap around the explosive part 100. The cloth layer 200 can be woven. The communication medium 300 can run essentially parallel with the explosive part 100. The communication medium 300 can also be wound around the explosive part 100, e.g., in a helical manner as shown in the FIG. 5. There can be more than one communication medium 300, as shown in FIG. 6. There is not a limit to the number of communication mediums 300 that can be used. The communication medium could also be embedded within the explosive 100. The communication medium 300 could be a woven metallic sheath surrounding the explosive 100.

Figure 2:
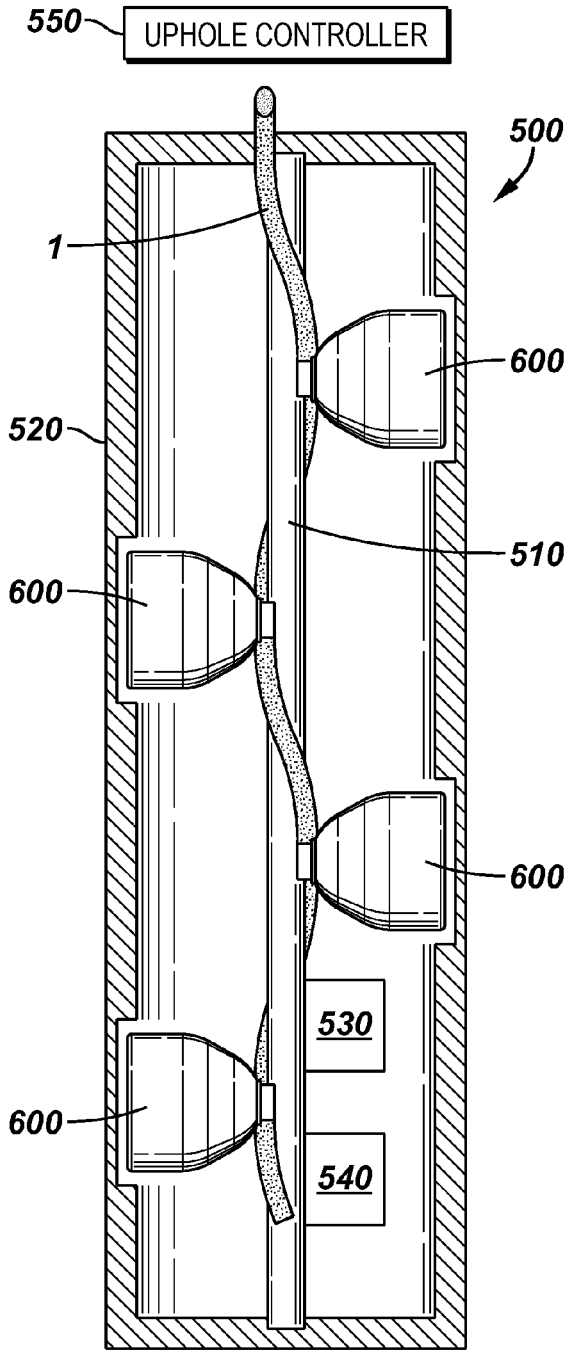
FIG. 2 is a cross-section of an embodiment.

FIG. 2 is a cross-section schematic of an embodiment of a perforating gun 500 according to the present application. A series of shape charges 600 are arranged on/around a sleeve 510. The sleeve 510 supports the shape charges 600. The shape charges 600 can be configured in many ways, e.g., helically, staggered, opposite from each other, etc. The detonating cord 1 extends within the perforating gun 600 and connects to the shape charges 600. The detonating cord 1 can connect to a controller 530. The controller can have integrated thereto, or be connected with, a sensor device 540. The sensor device 540 can be placed within the perforating gun 600 as shown. Also, sensor devices 540 can be associated/integrated with the individual shape charges 600 to detect if a shape charge has detonated. The sensor device(s) 540 can detect a number of attributes such as: temperature, pressure, vibration, current or voltage. A detonator can also be integrated with, or be separate from, the controller 530.

Figure 3:
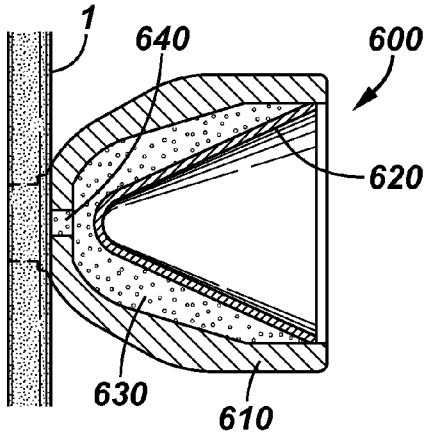
FIG. 3 is a cross-section of an embodiment.

FIG. 3 shows an embodiment of a shape charge 600 that can be incorporated into the perforating gun 500 as shown in FIG. 2. The shape charge 500 has a casing 610 and a liner 620. The casing 610 and the liner 620 contain explosive material 630. When the explosive material 630 detonates, the liner 620 is propelled outward in a direction away from the casing 610. The propulsion of the liner 620 is generally well known in the art of shape charges and is therefore not specifically described herein. A primer 640 can be used to detonate the explosive material 630.

During operation, an uphole controller 550 in FIG. 2 can be located uphole from the perforating gun 500. Preferably the uphole controller is at surface. The uphole controller can be connected to the communication medium 300 of the detonating cord 1. Alternately, the uphole controller can be connected to a communication line(s) (not shown) that in turn connects with the communication medium 300. The uphole controller can send signals to the communication medium 300 and receive signals transmitted through the communication medium 300.

Some control operations that are contemplated are transmission of sensor signals from the sensor 540 to the uphole controller. Any number of sensors can be integrated with the perforating gun 500. The sensors can communicate with the communication medium 300, preferably via the downhole controller 530, to send signals indicating the sensed parameters uphole to the uphole controller. Some aspects that can be detected are: pressure, temperature, acceleration, orientation, vibration, voltage or current.

The uphole controller can send signals through the communication medium 300 downhole to the downhole controller 530. The signals from the uphole controller can instruct certain operations for the downhole controller 530, e.g., arm a firing mechanism of the perforating gun 500, detonate the shape charges 600 in a particular order, detonate the shape charges 600 at a particular time, detonate the shape charges 600 after a period of time has elapsed, detonate once a certain depth has been reached, detonate once a pressure is reached, or detonate once an electronic or fiber-optic signal is received. The electronic, fiber-optic or pressure signal can be coded and can be addressed to a specific downhole controller.

As noted above, a number of perforating guns 500 can be connected in sequence, thereby producing a perforating gun string. When multiple perforating guns 500 are connected, the detonating cord 1 of one perforating gun 500 can be connected to the detonating cord 1 of another adjacent perforating gun 500. In that respect, it is possible to have downhole controllers 530 in each perforating gun 500 of a gun string, or less than all the perforating guns 500 of a gun string. For example, one controller 530 could be connected to shape charges 600 of other perforating guns 500 by way of the detonating cords 1 connected between adjacent perforating guns 500. Also, it is possible that detonating cords 1 of perforating guns 500 in a gun string not be connected, so long as the perforating guns 500 could have a controller 530 that is connected by means other than the detonating cord 1, e.g., alternate electrical or wireless connection.

The preceding description of embodiments is not meant to limit the scope of the following claims, but merely to better describe certain embodiments.

The invention claimed is:

1. A downhole perforating device, comprising:

a perforating gun having incorporated therein at least one shape charge;

an elongated detonating cord for detonating the shape charge, the detonating cord being incorporated with the perforating gun and extending along a length of the perforating gun, the detonating cord comprising:

a flexible jacket layer surrounding an explosive;

a communication medium including a metallic wire for communicating a signal, wherein the metallic wire is embedded within the flexible jacket layer; and an electrically insulating layer inside the flexible jacket layer separating the explosive from the metallic wire.

2. The downhole perforating device of claim 1, wherein the communication medium is in communicative connection with an uphole controller.

3. The downhole perforating device of claim 1, comprising:

a downhole controller integrated with the perforating gun;

wherein the communication medium is in communicative connection with the downhole controller.

4. A downhole perforating device, comprising:

a perforating gun having incorporated therein at least one shape charge;

an elongated detonating cord for detonating the shape charge, the detonating cord being incorporated with the perforating gun and extending along a length of the perforating gun, the detonating cord comprising:

a flexible jacket layer surrounding an explosive; and a communication medium embedded within the flexible jacket layer, wherein the communication medium is a pressure conduit.

5. The downhole perforating device of claim 3, wherein the downhole controller is integrated with a detonator.

6. The downhole perforating device of claim 2, wherein the uphole controller receives signals through the communication medium and transmits signals through the communication medium.

7. The downhole perforating device of claim 1, wherein the explosive is surrounded by a woven sheath, the electrically insulating layer including the woven sheath.

8. The downhole perforating device of claim 1, comprising at least two communication media.

9. The downhole perforating device of claim 1, wherein the communication medium is wrapped helically around the explosive.

10. The downhole perforating device of claim 1, wherein the flexible jacket layer comprises elastomer.

11. An elongated detonating cord, comprising:

a flexible jacket surrounding an explosive;

a communication medium embedded within the flexible jacket, wherein the communication medium is wrapped helically around the explosive.

12. The detonating cord of claim 11, wherein the communication medium is adjacent to the explosive.

13. The detonating cord of claim 12, comprising:

a cloth sheath surrounding the explosive.

14. The detonating cord of claim 12, wherein the communication medium is a metallic wire.

15. The detonating cord of claim 12, wherein the communication medium is a fiber-optic light conducting member.

16. An elongated detonating cord, comprising:

a flexible jacket surrounding an explosive;

a communication medium embedded within the flexible jacket, wherein the communication medium is a pressure conduit.

17. The detonating cord of claim 11, comprising at least two communication media.

18. The downhole perforating device of claim 4, wherein the flexible jacket layer comprises elastomer.

19. A method of detonating a downhole perforating device, comprising:

placing downhole a perforating gun having incorporated therein at least one shape charge, an elongated detonating cord incorporated with the perforating gun and extending along a length of the perforating gun, the detonating cord comprising: a flexible jacket surrounding an explosive, a communication medium including an electrical wire embedded within the flexible jacket, and an electrically insulating layer separating the explosive from the electrical wire, wherein the communication medium is in communicative connection with an uphole controller, and a downhole controller is integrated with the perforating gun, wherein the communication medium is in communicative connection with the downhole controller to provide a signal to the downhole controller.

20. The method of claim 19, further comprising:

transmitting the signal from the uphole controller though the communication medium downhole to the downhole controller.

21. The method of claim 20, further comprising:

actuating the at least one shape charge based on the signal transmitted downhole.

22. A downhole perforating device, comprising:

a perforating gun having incorporated therein at least one shape charge;

an elongated detonating cord for detonating the shape charge, the detonating cord being incorporated with the perforating gun and extending along a length of the perforating gun, the detonating cord comprising:

a flexible jacket layer surrounding an explosive; and a communication medium embedded within the flexible jacket layer, wherein the communication medium is wrapped helically around the explosive.

* * * * *